United States Patent [19]

Jarrott et al.

[11] 4,455,215

[45] Jun. 19, 1984

[54] PROCESS FOR THE GEOCONVERSION OF COAL INTO OIL

[76] Inventors: David M. Jarrott, 1514 Jefferson Ave., New Orleans, La. 70112; Frank E. Jarrott, 205 Woodhaven, De Soto, Tex. 75115

[21] Appl. No.: 372,919

[22] Filed: Apr. 29, 1982

[51] Int. Cl.[3] ..... C10G 1/00; E21B 43/27

[52] U.S. Cl. ..... 208/8 LE; 166/300

[58] Field of Search ..... 208/8 LE

[56] References Cited

U.S. PATENT DOCUMENTS

| | | | |
|---|---|---|---|
| 2,595,979 | 5/1952 | Pevere et al. | 196/53 |
| 3,642,607 | 2/1972 | Seltzer | 209/8 |
| 3,705,092 | 12/1972 | Gatsis | 208/8 LE |
| 3,707,461 | 12/1972 | Gatsis | 208/8 LE |
| 4,057,293 | 11/1977 | Garrett | 299/2 |
| 4,082,643 | 4/1978 | Gatsis et al. | 208/8 LE |
| 4,095,650 | 6/1978 | Shuck | 166/256 |
| 4,108,759 | 8/1978 | Young | 208/10 |
| 4,115,075 | 9/1978 | McNamee et al. | 48/197 R |
| 4,140,184 | 2/1979 | Bechtold et al. | 166/300 |
| 4,152,244 | 5/1979 | Raichle et al. | 208/8 R |
| 4,326,945 | 4/1982 | Flagg et al. | 208/8 LE |
| 4,337,148 | 6/1982 | Dick | 208/8 LE |

OTHER PUBLICATIONS

Volcanoes, Gordon A. Macdonald, U. of Hawaii, Prentice Hall Inc., Englewood Cliffs, N.J. 1972, pp. 23, 54–57, 399–408.

*Primary Examiner*—William G. Wright

*Attorney, Agent, or Firm*—Bollo & Drumm

[57] ABSTRACT

A process for the geoconversion of coal into oil comprising the steps of forming a coal slurry, injecting the coal slurry into a preselected oil well to provide an environment for the coal slurry having predetermined pressure conditions of approximately 1500 to 4500 lbs./in.$^2$ and temperature conditions of approximately 200° to 300° F., converting the coal into oil as a result of the combined action of the heat and pressure upon the coal, and removing the resulting oil after sufficient time has elapsed for conversion of the coal into oil.

8 Claims, 2 Drawing Figures

PROCESS FOR THE GEOCONVERSION OF COAL INTO OIL

BACKGROUND OF THE INVENTION

The present invention relates to geoconversion of coal into oil, and more specifically to subsurface conversion in existing oil wells. "Geoconversion" is defined as the utilization of the natural geological forces of heat and pressure to convert prepared coal into a petroleum product, specifically oil.

It is well known that the application of sufficient heat and pressure to coal will cause conversion of the coal into oil. Most techniques using this principle have sought to create such conditions above ground where the coal is present after mining. This results in a significant expense in building apparatus to create such conditions, as well as wasting energy.

Techniques are also known for in situ subsurface conversion of non-mined coal into oil, see for example U.S. Pat. No. 4,057,293, granted to Donald E. Garrett, and U.S. Pat. No. 2,595,979, granted to E. F. Pevere et al. U.S. Pat. No. 4,140,184 granted to Ira C. Bechtold et al. discloses the injection of an aqueous slurry of a carbon containing material selected from a specified group, including limestone and oil, into a hot subterranean chamber for reaction with water in the presence of heat supplied from a hot magma.

SUMMARY OF THE INVENTION

It is object of the present invention to provide a process for economically converting coal into oil.

It is a further object of the present invention to provide a geoconversion process for converting coal into oil.

It is still further object of the present invention to provide a non-polluting process for converting coal into oil.

It is a still further object of the present invention to provide a process for converting coal into oil which avoids the necessity of creating an expensive surface apparatus capable of providing the requisite heat and pressure to accomplish such conversion.

It is a still further object of the present invention to overcome certain disadvantages present in known coal conversion processes.

Briefly, in accordance with the present invention a process is provided for geoconversion of coal into oil comprising the steps of forming coal slurry, injecting the coal slurry into a preselected oil well to provide an environment for the coal slurry predetermined pressure conditions of approximately 1500 to 4500 lbs./in.$^2$ and predetermined temperature conditions of approximately 200° to 300° F., converting the coal into oil as a result of the combined action of the heat and pressure upon the coal, and removing the resulting oil after sufficient time has elapsed for conversion of the coal into oil.

Other objects, aspects and advantages of the present invention will be apparent when the detailed description is considered in conjunction with the drawings, illustrating the preferred embodiment for carrying out the process, as follows.

DETAILED DESCRIPTION

Figures 1, 2:
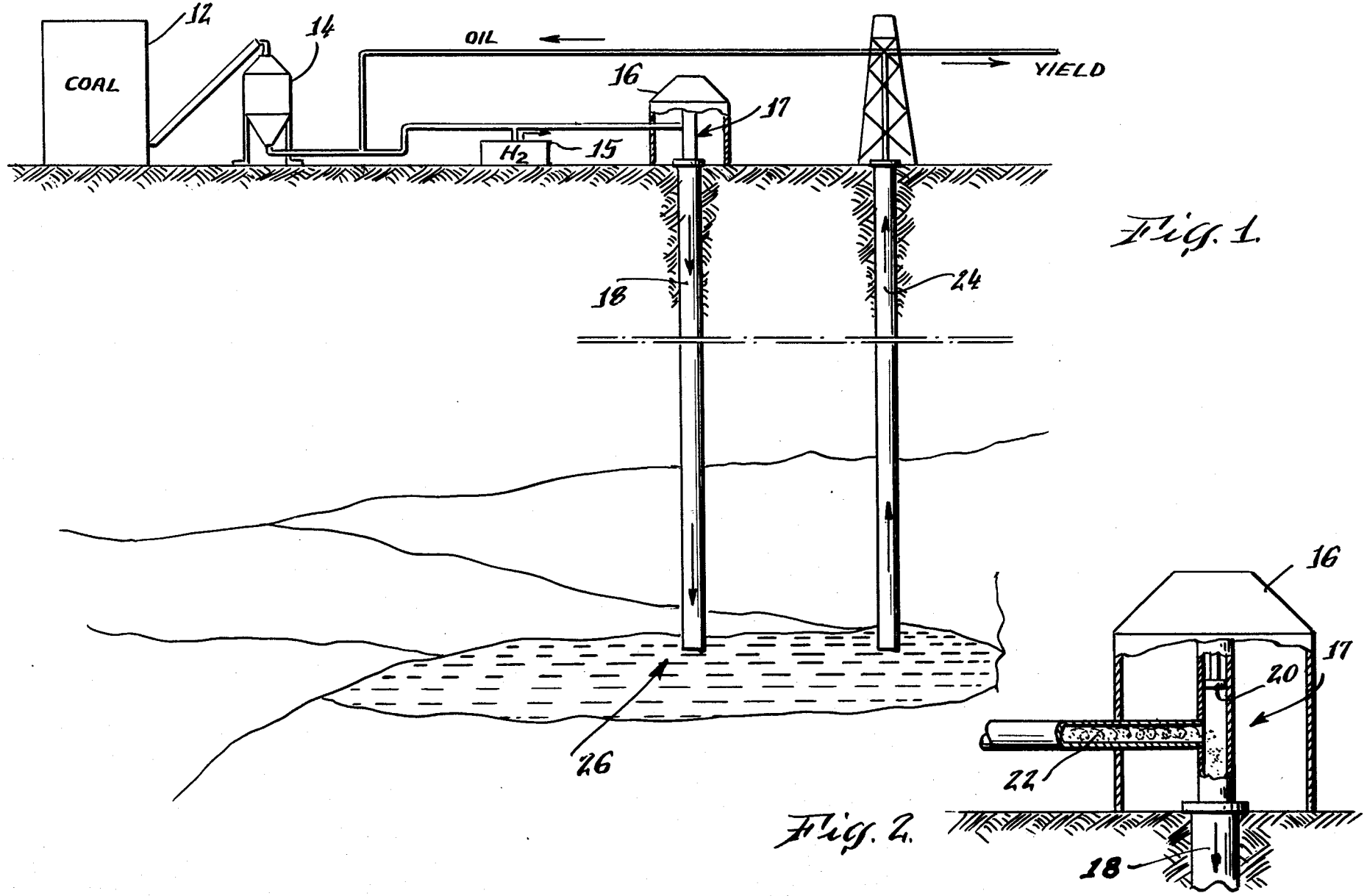
FIG. 1 is a side elevational view, with parts broken away, of apparatus for carrying out the process of the present invention.
FIG. 2 is a partial enlarged view of one form of the coal slurry injector used in the process of the present invention.

Referring to FIG. 1, one form of apparatus for carrying out the process of the present invention is illustrated generally in FIG. 1. Previously mined coal is delivered to an on-site storage facility 12. The coal may comprise any of the well known types, e.g., Texas lignite. The coal is conveyed to a conventional crusher 14 by suitable means, such as a conventional coal conveyer. The crusher 14 preferably includes a conventional roll crusher to reduce the coal to pebble size of from ⅜ inch to about 1½ inches and a conventional cone crusher to comminute the coal pebbles to particles in the range of about 100 to 200 mesh.

The pulverized coal is mixed with crude oil, to form a coal slurry or sludge. Preferably, the percent of coal in the slurry is in the range of about 60% to about 80%.

The coal slurry is transported to a conventional injector 16 positioned at the top of well head 17 of a preselected oil well 18. Advantageously, as shown in FIG. 2, the injector 16 may include a diesel or steam driven pile 20, able to withstand pressures of approximately 3000 lbs./in.$^2$ and having a capacity of about 0.1 to 0.5 cubic yards per stroke for injecting the coal slurry into the preselected oil well 18. The coal slurry may be transported to the injector 16 by a conventional screw conveyer 22.

Hydrogen may be injected into the coal slurry prior to injection into the head of the well 18 to aid in the formation of hydrocarbons, specifically oil. The need for hydrogen and the amount thereof is determined by the petrochemical and geological factors present at a given geoconversion site, i.e., the type of coal used, the temperatures and pressures present in the coal conversion zone and the characteristics of the crude oil within the conversion zone. Advantageously, the source 15 of hydrogen may be obtained from the electrolysis of water located at or transported to the geoconversion site.

Taking advantage of the naturally occurring geological forces which exist in preselected oil wells 18 is the central aspect to carrying out the process of the present invention. The well 18 should have a minimum depth below the earth's surface of approximately 10,000 feet to insure that temperature and pressure conditions are present, which will result in conversion of the translocated coal into oil. The acceptable range of depth for the well 18 is approximately 10,000 to about 20,000 feet. Typically mature oil fields will have a majority of wells in the shallow end of the range. Steam injection, which wil be discussed in more detail below can be used in with wells having a depth of less than 10,000 feet.

Injection of the coal slurry to the depths specified places the coal slurry in the environment where the proper geological forces exist to convert the coal into oil. Preferably, the pressure on the injected coal will be approximately 3,000 lbs./in.$^2$ However, the acutal pressure achieved will depend upon the depth of the injection well. Pressures in the range of about 1500 to about 4500 lbs./in.$^2$ are acceptable. Preferably, the temperature encountered by the injected coal would be approximately 200 to 300° F. This is achieved at depths of 10,000 to 20,000 feet. An increased temperature will hasten the conversion process and reduce the requirements for increased pressure. Therefore, the particular combination of temperature and pressure is directly dependent upon the depth of the well and the geological factors present at the depth, and will directly affect the rate of conversion of the coal into oil.

It is estimated that 600 tons of coal will yield approximately 1,800 barrels of oil, i.e., 1 ton of coal will yield approximately 3 barrels of oil. Assuming that the diameter of the well is approximately 2 feet it is estimated that a coal slurry column of 14 feet would approxmate 1 ton. It is estimated that each load of coal to be injected would be approximately 1000 pounds, i.e., representing a column 7 feet high. Such load would be injected into the well 18 to the desired depth by the stream driven pile 20. Assuming injection of a load of coal occurs every 10 minutes, the amount of coal used would be 3 tons/hour or 72 tons/day. The dwell time of the coal slurry in the well prior to conversion into oil is determined by the actual temperature and pressure conditions present in the conversion zone. A dwell time of between about one (1) and about thirty (30) days is envisioned. The actual conversion of coal into oil may occur within the well pipe, if the necessary temperatures and pressure conditions are achieved prior to the coal slurry reaching the oil bearing rock strata.

As desired, the geoconversion process of the present invention may be utilized for intermittent or continuous production in accordance with the following examples:

INTERMITTENT PRODUCTION

Referring to FIG. 1, a producing oil well 18, e.g. producing 10 barrels per day (b/d), is to be utilized for geoconversion. For a certain period of time the normal production of oil is interrupted and coal slurry in the amount of 72 tons per day is injected. After 90 days the injection of coal is stopped and the well 18 remains quiescent for 30 days (hypothetical dwell time for the conversion of coal into oil). The equivalent of approximately 18,000 barrels of oil have been injected into the well 18. Assuming that 50% of the oil is recovered over the next 90 days, the geoconversion process of the present invention will result in the production of 9,000 barrels of oil (average of 426 b/d) as compared with 2100 barrels (10 b/d) by that same well 18 over the 210 day period. At whatever rate the oil resulting from the geoconversion process is recovered, it represents an effective reservoir of approximately 18,000 barrels of oil.

CONTINUOUS PRODUCTION

Referring again to FIG. 1, two adjacent wells 18 and 24 which have penetrated the same oil bearing strata 26 may be utilized for continuous production. The coal slurry is injected into well 18. The crude oil employed in the preparation of the coal slurry is obtained from well 24. After the coal injection into well 18 has continued for some period of time, e.g., 90 days, the production from well 24 will increase due to the presence of the oil resulting from the coal conversion. Eventually, the production of well 24 should match the input oil equivalent of the coal injected into well 18, depending of course upon the actual % recovery. For example, if wells 18 and 24 originally produced 10 b/d each, making the same assumptions for conversion as with the Intermittent Production, the eventual production of well 24 would be 100 b/d, some of which, e.g. 40 b/d, would be combined with the pulverized coal to form the coal slurry for injection into well 18; the remainder would represent the resulting yield from the two wells 18 and 24. Therefore, the overall oil production of these two wells would increase from 20 b/d to 60 b/d.

Initially with the continuous production approach, the resulting yield will be zero, since all the oil from well 24 is used in the preparation of the coal slurry for injection into well 18. Gradually, the oil production of well 24 will increase. Eventually, a relatively stable condition will result where the oil production of well 24 approaches the oil equivalent of the coal injected into well 18, less the amount which is not recoverable.

In both examples, the coal slurry is injected into well 18 at 72 tons/day, which is equivalent to approximately 200 barrels of oil. Assuming a recovery rate of 50%, the production rate of well 18 will increase from 10 b/d to 100 b/d, of which 40 b/d is recycled to prepare new coal slurry for injection into well 18.

One possible variation in or adjunct to the process involves the injection of steam to bring the temperature of the coal slurry into the desired range of 200°-300° F. when a shallow well of less than 10,000 feet is employed or if the geological factors present at the conversion depth are such that the desired temperature range is not achieved. Standard injection techniques such as are currently employed in the production of high viscosity crude oil can be employed.

The combination of coal and heat and pressure, in the presence of hydrogen, for a sufficient time results in a chemical reaction forming polymers, and hence oil. Advantageously, the resulting oil may be pumped from preselected well 18 (intermittent production) or adjacent well 24 (continuous production) in the conventional manner.

It should be understood by those skilled in the art that various modifications may be made in the process of the present invention without departing from the spirit and scope thereof, as described in the specification and defined in the appended claims.

What is claimed is:

1. A process for the geoconversion of coal into oil, comprising the steps of:

forming a coal slurry of coal and crude oil in which the percentage of coal in the coal slurry is in the range of about 60% to about 80%;

injecting the coal slurry into a preexisting oil well having a depth of about 10,000 to about 20,000 feet below the earth's surface to provide a geoconversion environment for the coal slurry having predetermined pressure conditions of approximately 1,500 lbs./in.$^2$ to 4,500 lbs./in.$^2$ and temperature conditions of approximately 200° to approximately 300° F.;

converting the coal into oil as a result of the combined action of the heat and pressure upon the coal; and removing the resulting oil after sufficient time has elapsed for conversion of the coal into oil.

2. The process recited in claim 1, wherein the step of forming the coal slurry includes the steps of:

pulverizing the coal to a particle size in the range of about 100 to about 200 mesh; mixing crude oil with the pulverized coal to form the coal slurry.

3. The process recited in claim 2, including the step of:

injecting hydrogen into the coal slurry prior to injecting the coal slurry into the preexisting oil well.

4. The process recited in claim 3, including the step of:

providing hydrogen from the on-site electrolysis of water.

5. The process recited in claim 1, wherein the step of removing the resulting oil includes:

removing the resulting oil through the preexisting oil well.

6. The process recited in claim 1, wherein the step of removing the resulting oil includes:

removing the resulting oil through a preexisting adjacent oil well which has penetrated the same oil bearing strata as the preexisting oil well.

7. The process recited in claim 6, including the step of:

using a portion of the oil removed through the adjacent well to form the coal slurry.

8. The process recited in claim 1, including the step of:

injecting steam into the preselected oil well to provide a temperature in the range of about 200° to about 300° F.

* * * * *